United States Patent [19]

Pallaver et al.

[11] 4,087,988

[45] May 9, 1978

[54] CRYOGENIC EXPANSION MACHINE

[75] Inventors: Carl B. Pallaver, Woodridge; Michael W. Morgan, Palos Park, both of Ill.

[73] Assignee: The United States of America as represented by the United States Department of Energy, Washington, D.C.

[21] Appl. No.: 740,330

[22] Filed: Nov. 9, 1976

[51] Int. Cl.[2] ..... F25B 19/00

[52] U.S. Cl. ..... 62/514 JT; 74/568 R; 91/37

[58] Field of Search ..... 62/514 R, 514 JT; 91/37; 74/568 R

[56] References Cited

U.S. PATENT DOCUMENTS

| | | | |
|---|---|---|---|
| 2,803,226 | 8/1957 | Renoux | 91/37 |
| 3,252,291 | 5/1966 | Eder | 62/514 JT |
| 3,301,089 | 1/1967 | Wechsler | 74/568 R |
| 3,320,755 | 5/1967 | Jepsen | 62/514 JT |
| 3,418,824 | 12/1968 | Beutel | 62/514 R |
| 3,459,402 | 8/1969 | Weaver | 91/37 |
| 3,550,568 | 12/1970 | Peterson | 74/568 R |
| 3,839,925 | 10/1974 | Ficken | 74/568 R |
| 4,004,497 | 1/1977 | Scholin | 91/37 |

*Primary Examiner*—Martin P. Schwadron
*Assistant Examiner*—Abraham Hershkovitz
*Attorney, Agent, or Firm*—Dean E. Carlson; Frank H. Jackson

[57] ABSTRACT

A cryogenic expansion engine includes intake and exhaust poppet valves each controlled by a cam having adjustable dwell, the valve seats for the valves being threaded inserts in the valve block. Each cam includes a cam base and a ring-shaped cam insert disposed at an exterior corner of the cam base, the cam base and cam insert being generally circular but including an enlarged cam dwell, the circumferential configuration of the cam base and cam dwell being identical, the cam insert being rotatable with respect to the cam base.

2 Claims, 5 Drawing Figures

CRYOGENIC EXPANSION MACHINE

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to a cryogenic expansion engine. In more detail the invention relates to a reciprocating expansion-engine refrigerator for cooling helium to a low temperature.

Large quantities of liquid helium are required for cooling superconducting magnets employed in particle accelerators. Helium can be liquified with refrigeration systems using a Joule Thompson valve with an expansion engine. In such devices a valve is opened allowing high pressure low temperature helium gas to enter a cylinder and expand against a piston causing the piston to move. During this movement the gas expands in the cylinder lowering pressure and temperature. Another valve then opens and the return motion of the piston forces the cooled gas out of the cylinder for further cooling and liquification.

Cryogenic expansion engines have a history of high maintenance and difficulty in matching engine performance with refrigerator components. The cryogenic expansion engine described herein is particularly useful in a system for liquefying large quantities of helium because of ease of maintenance and easy adjustability of the valve action.

DETAILED DESCRIPTION OF THE INVENTION

Figure 1:
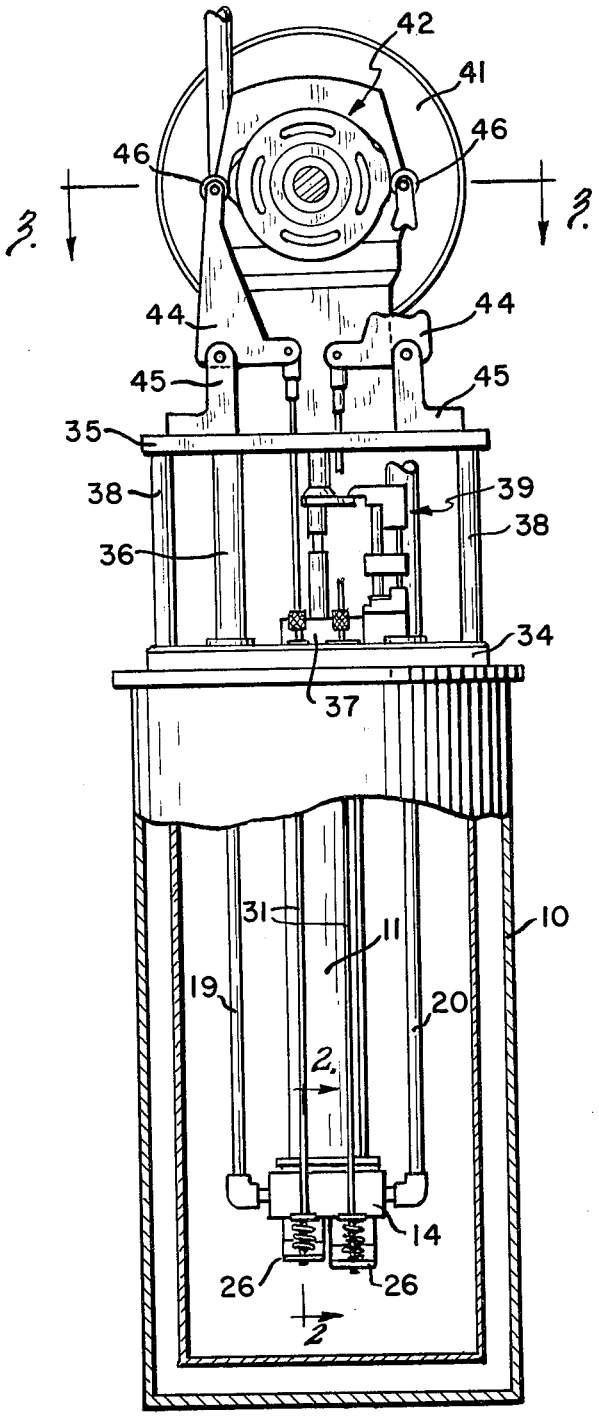
FIG. 1 is a vertical elevation partly broken away of a cryogenic expansion engine according to the present invention.
Figure 2:
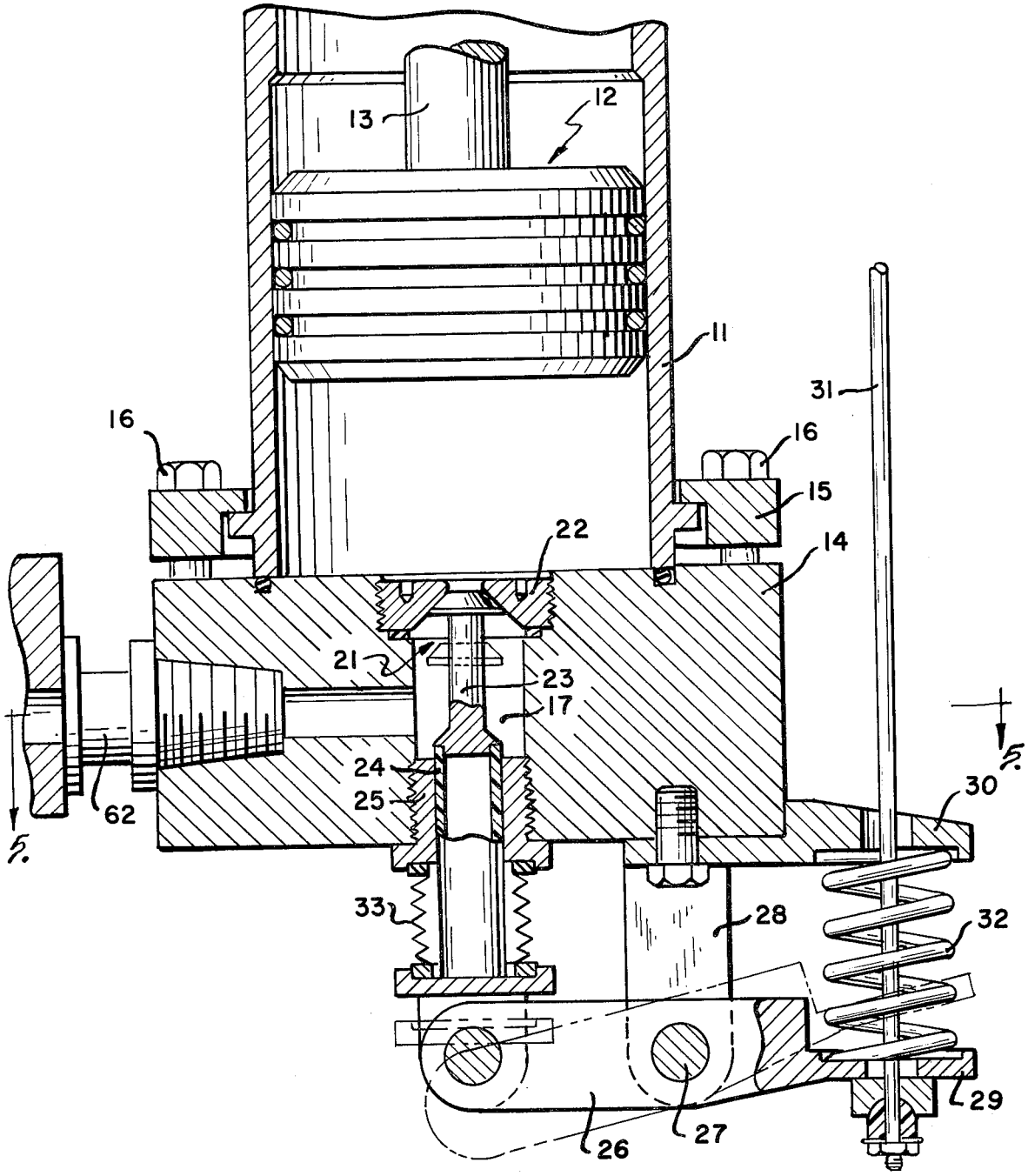
FIG. 2 is a vertical section of a portion thereof taken on the line 2—2 of FIG. 1.
Figure 5:
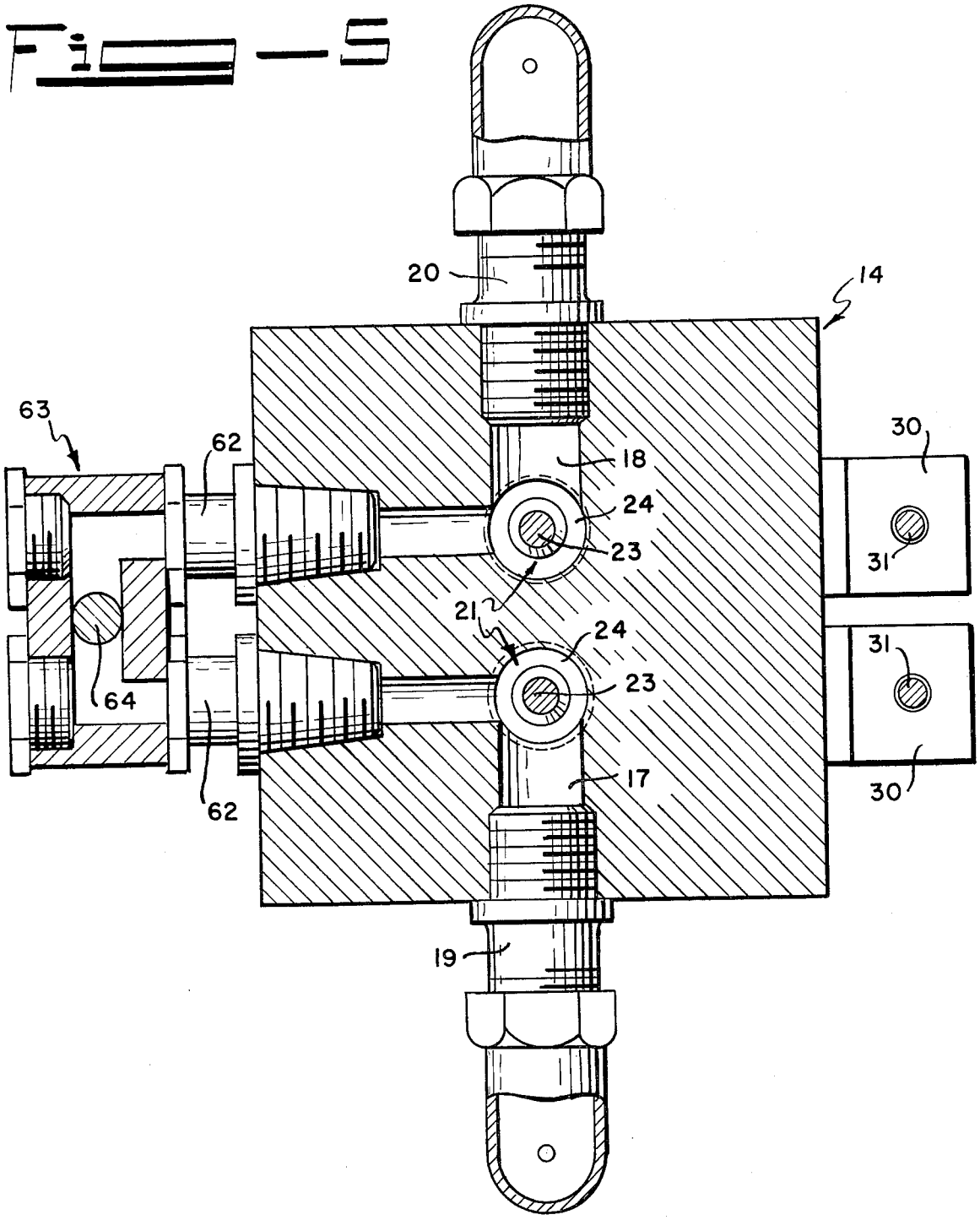
FIG. 5 is a horizontal section taken on the line 5—5 in FIG. 2.

Referring to FIGS. 1 and 2 of the drawing a double-wall DeWar vessel 10 encloses an expansion cylinder 11 having a piston 12 attached to a piston rod 13 reciprocable therein. A cylinder head 14 is attached to the lower end of cylinder 11 by retainer ring 15 and bolts 16. Cylinder head 14 contains an inlet chamber 17 and an outlet chamber 18 (see FIG. 5); an inlet line 19 communicates with the inlet chamber and an outlet line 20 communicates with the outlet chamber. A bypass line 62 which is controlled by valve 63 including valve stem 64 is employed in startup of the machine. Communication between the inlet and outlet chambers and the interior of cylinder 11 is controlled by poppet valves 21, threaded, removable seats 22 therefore being provided in the top wall of the cylinder head 14. Valve stems 23 connect the valves to cylindrical Teflon bearings 24 which extend through threaded, removable sleeves 25 in the lower wall of the cylinder head 14 to one end of rocker arms 26, pivoted on shaft 27 — which is supported from cylinder head 14 by bracket 28 — the other end of rocker arms 26 terminating in spring retainers 29. Cooperating spring retainers 30 are fastened to cylinder head 14 and vertical actuating rods 31 extend through spring retainers 29 and 30 with springs 32 therebetween holding the spring retainers apart. Bellows seals 33 surround Teflon bearings 24.

Referring now only to the upper portion of FIG. 1 DeWar vessel 10 is surmounted by spaced support plates 34 and 35, plate 34 constituting the top of the cylinder. Sleeves 36 for the upper portions of inlet and outlet lines 19 and 20 rest on plate 34 as does piston rod seal 37 and support columns 38 extend between plates 34 and 35.

A slide assembly 39 electrically indicates travel of the piston rod 13. Flywheel 41 and a cam assembly 42 to be described in detail hereinafter, are on cam shaft 43. Power is absorbed through a hydraulic load system (not shown). Piston rod 13 is connected to cam shaft 43 by a commercially available power drive (not shown).

A pair of L-shaped lever 44 are pivotally supported by plate 35 by pivot blocks 45, the end of the short, horizontal arm of each of the L-shaped levers being attached to the top of an actuating rod 31, the end of the long, vertical arm of each of the L-shaped levers terminating in a cam follower 46.

Figure 3:
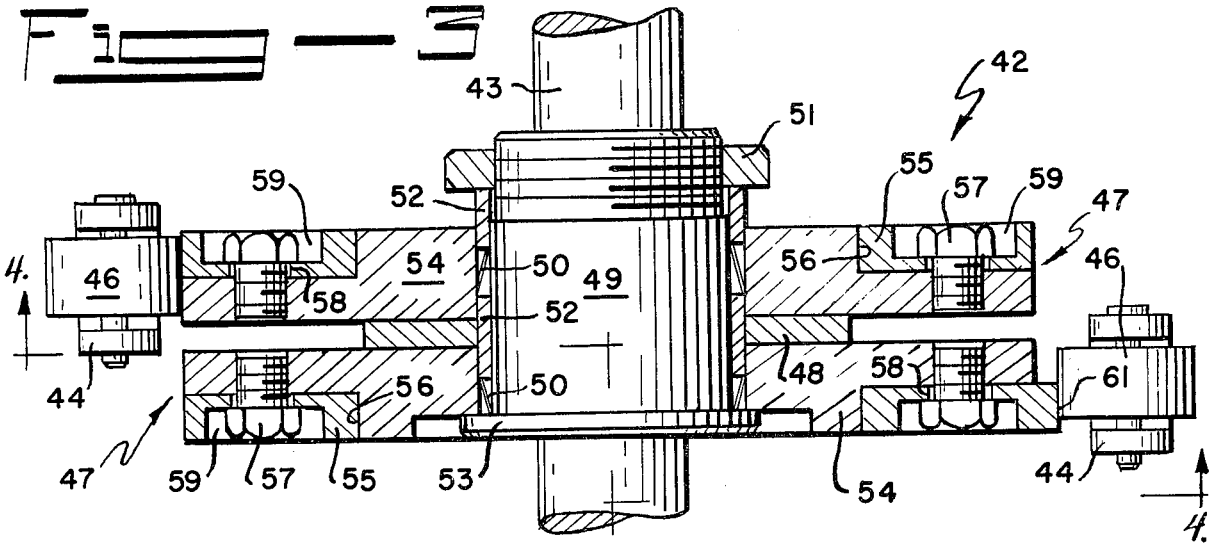
FIG. 3 is a horizontal section of the camming system employed in the cryogenic expansion engine taken on the line 3—3 of FIG. 1.
Figure 4:
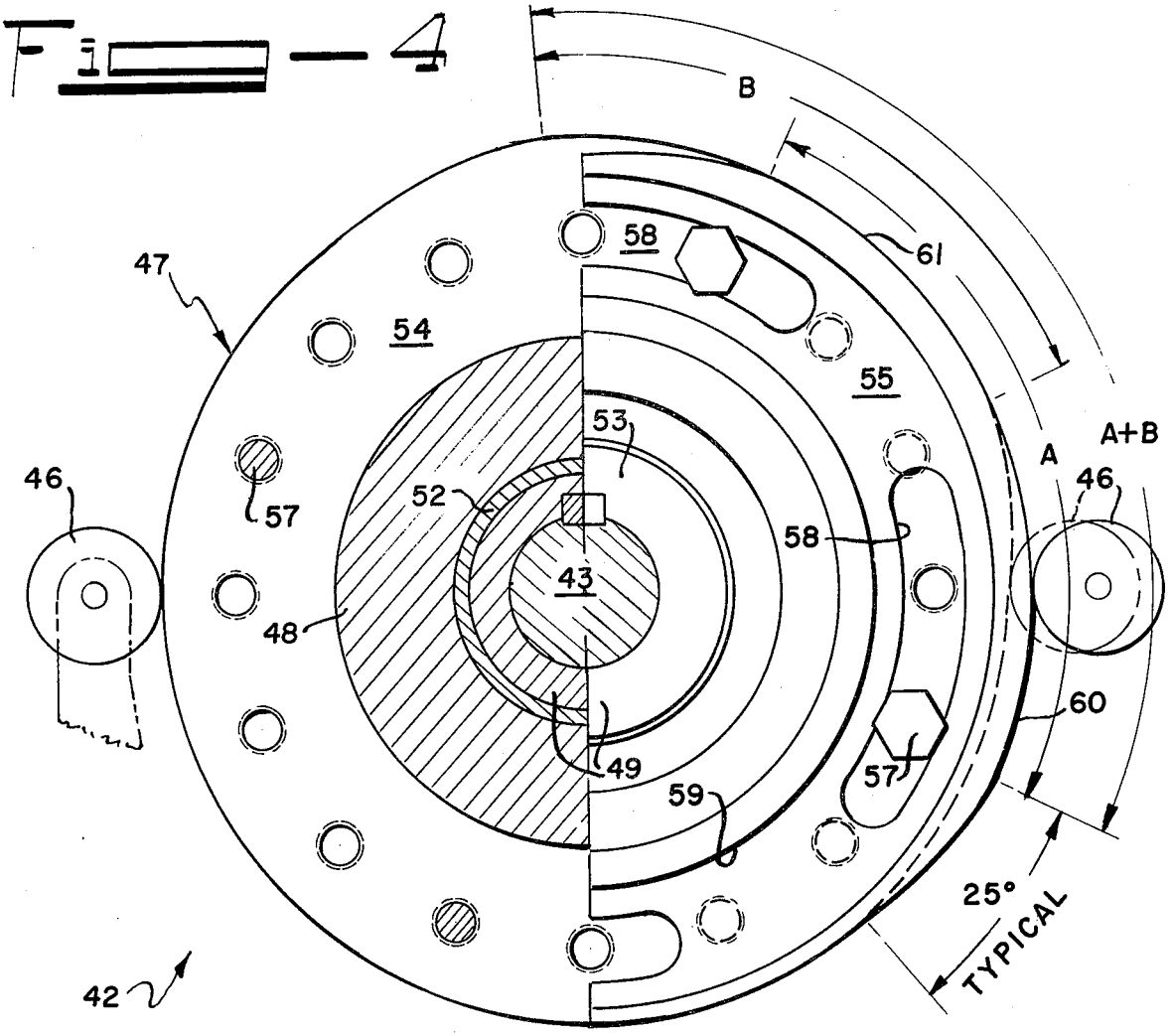
FIG. 4 is a vertical elevation taken partly in section thereof on the line 4—4 of FIG. 3.

Referring now to FIGS. 3 and 4 cam assembly 42 includes a pair of separately adjustable cams 47 — separated by a ring spacer 48 — which are locked to hub 49 by conventional cylindrical locking elements 50 which are separated from each other and from a nut 51 by cylindrical spacers 52. Screwing nut 51 down forcing the stack of spacers and locking elements against the flange 53 on the bottom of the hub will cause the locking elements to expand by a wedging action against the cams and the hub. Cams 47 are separately rotatable on hub 49 when the nut 51 is relaxed. Hub 49 is preferably integral with cam shaft 43. If a separate piece it must be rigidly tied thereto.

Each cam 47 includes a cam base 54 and a ring-shaped cam insert 55 disposed at an exterior corner 56 of the cam base. Cam insert 55 is held therein by hex nuts 57 which are recessed in annular slot 59 in cam insert 55 and extend through arcuate slot 58 therein into threaded engagement with cam base 54. Each cam base 54 is generally circular but includes an enlarged portion or cam dwell 60 through which the diameter is constant but larger than that of the remainder of the cam base. Similarly each cam insert 55 is generally circular but includes an enlarged portion or cam dwell 61 of identical configuration to that of the cam base. Cam follower 46 rides on both cam base and cam insert. Accordingly, when cam base and cam insert are adjusted so that the cam dwell is of minimum length, the poppet valve 21 controlled by that cam will be open minimum time; when the cam insert is rotated with respect to the cam base so that the cam dwells thereon are completely complementary, the poppet valve 21 controlled by that valve will be open twice the minimum time. Desirable dwells would be $7\frac{1}{2}°$ for the intake cam and 90° for the outlet cam making an infinite numbers of variations possible between $7\frac{1}{2}°$ and 15° for the intake cam and 90 and 180° for the outlet cam. It should be noted that cam base and cam insert must be machined together so as to make one inseparable assembly.

It will be noted that the cryogenic expansion engine described above includes several novel features making adjustment and maintenance easy. Provision of threaded removable inserts in the head make maintenance relatively easy. It had previously been felt that removable valve seats could not be used at the extremely low temperatures of this expansion engine since there might be shrinkage of the insert. It has been found that no such problem exists. In order to attain maximum efficiency, it is necessary that provision be made for adjusting the timing of the valve action and this is done conveniently by the adjustable cams described.

In one particular system helium is admitted to the expansion engine described above at 200 psi and 20° K and is exhausted therefrom at ½ psi and 12° K. It is subsequently liquified in further equipment forming no part of the present invention.

A more detailed description of the mode of operation of the entire device disclosed follows: Helium which has previously been cooled to 20° k at 200 psi in equipment forming no part of the present invention is introduced into inlet chamber 17 through line 19. Poppet valve 21 is opened when the dwell 60, 61 of inlet cam 47 makes contact with cam follower 46 turning lever 44 and raising actuating rod 41. Helium thereupon flows into expansion cylinder 11. Further rotation of inlet cam 47 permits poppet valve 21 to close and the helium in cylinder 11 expands against piston 12 and is thereby cooled. Piston 12 is returned to its original position by piston rod 13 which is connected to cam shaft 43 by a commercially available power drive (not shown). Cam shaft 43 is turned by a motor (not shown). As piston 12 moves downwardly, poppet valve 21 leading to outlet chamber 18 is opened by the cam dwell on outlet cam 47 and the helium is exhausted from the expansion chamber through outlet line 20 at 12° K and ½ psi.

Cams 47 are separately rotatable on hub 49 so that they can be separately adjusted to hold the poppet valves 21 open anywhere from a minimum length of time (established by the angular extent of the cam dwell on the cam base) and double that time.

The device as shown and described forms part of a system designed for use in liquefying helium to be used in cooling superconducting magnets employed in the particle accelerator at Fermilab, Batavia, Ill.

The embodiments of the invention in which an exclusive property or privilege is claimed are defined as follows:

1. A cryogenic expansion engine comprising a DeWar vessel enclosing an expansion cylinder having a piston reciprocable therein, a cyliner head removably fastened to the bottom of the expansion cylinder, said cylinder head including a top and bottom wall, inlet and outlet poppet valves seated in a removable, threaded insert in the top wall of the cylinder head, said poppet valves placing inlet and outlet lines in communication with the expansion cylinder, means for opening and closing the poppet valves on a predetermined schedule including two cams, each cam including a cam base and a ring-shaped cam insert disposed at an exterior corner of the cam base, said cam base and cam insert being generally circular but including an enlarged cam dwell, the outer circumference of the cam base and cam insert being identical in configuration and diameter, said cam insert being rotatable with respect to the cam base and cam followers connected to said valves adapted to ride on both cam base and cam insert, said poppet valves and cam followers being connected by vertical actuating rods, rocker arms connected at one end to the bottom of said actuating rods and at the other to plastic bearings which in turn are connected to valve stems for the poppet valves, said plastic bearings extending through threaded removable inserts in the bottom wall of the removable head and bellows seals surrounding the plastic bearings.

2. A cryogenic expansion engine comprising a DeWar vessel enclosing an expansion cylinder having a piston reciprocable therein, a cylinder head including an upper wall and a lower wall having two chambers therein removably attached to the bottom of the expansion cylinder, an inlet line communicating with one chamber, an outlet line communicating with the other chamber, an inlet and an outlet poppet valve seated in removable, threaded inserts in the top wall of the valve block controlling communication between the chambers in the cylinder head and the cylinder, inlet and outlet cams and cam followers for opening and closing said poppet valves, said cam followers being connected to the top of the vertical arm of a pivotally mounted L-shaped lever, the end of the short arm of the L-shaped lever being connected to the top of an actuating rod, the bottom end of the actuating rod being connected to one end of a rocker arm, the other end of the rocker arm being connected to the bottom of a plastic bearing, the plastic bearing being connected to the poppet valve by a valve stem, said plastic bearing extending through a threaded removable insert in the lower wall of the cylinder head and being surrounded by a bellows seal, said actuating rods being spring biased in a downward direction to hold the poppet valves closed, said cams consisting of a generally circular cam base and a ring shaped cam insert disposed at an exterior corner of the cam base having the same circumferential configuration including an enlarged cam dwell, said cam insert being rotatably adjustable with respect to the cam base to vary the length of the cam dwell, the cam followers riding on both cam base and cam dwell.

* * * * *